US005406655A

United States Patent [19]

Sahlin

[11] Patent Number: 5,406,655

[45] Date of Patent: Apr. 18, 1995

[54] APPARATUS FOR SUPPORTING AN INFANT DURING BATHING

[76] Inventor: Christine A. Sahlin, 2166 Babcock, Troy, Mich. 48084

[21] Appl. No.: 55,191

[22] Filed: Apr. 30, 1993

[51] Int. Cl.[6] ..... A47K 3/024

[52] U.S. Cl. ..... 4/572.1; 5/655

[58] Field of Search ..... 5/572.1, 586, 587, 585, 5/110–114, 638, 643, 655, 122, 127; 4/573.1, 578.1

[56] References Cited

U.S. PATENT DOCUMENTS

| | | | |
|---|---|---|---|
| 736,032 | 8/1903 | Silver . | |
| 830,837 | 9/1906 | Hurst | 5/643 X |
| 1,073,435 | 9/1913 | Owsley . | |
| 1,296,238 | 3/1919 | Vanderhoof . | |
| 1,650,067 | 11/1927 | Graves . | |
| 2,089,801 | 8/1937 | Kennedy . | |
| 2,156,507 | 5/1939 | Means | 5/110 X |
| 2,209,145 | 7/1940 | Weber | 5/114 X |
| 2,314,771 | 3/1943 | Compton | 5/643 X |
| 2,491,223 | 12/1949 | Stadlman . | |
| 2,507,848 | 5/1950 | Bashaw . | |
| 2,560,575 | 7/1951 | Holland, Sr. . | |
| 3,426,367 | 2/1969 | Bradford | 5/114 |
| 3,799,228 | 3/1974 | Crawford | 4/572.1 X |
| 3,837,019 | 9/1974 | Hoff . | |
| 4,602,392 | 7/1986 | Grier et al. . | |
| 4,777,674 | 10/1988 | Payton et al. . | |
| 4,837,871 | 6/1989 | Wheeler . | |

FOREIGN PATENT DOCUMENTS

| | | | |
|---|---|---|---|
| 0673488 | 1/1930 | France | 4/585 |
| 0998629 | 9/1949 | France | 5/111 |
| 1115497 | 4/1956 | France | 5/110 |
| 0484867 | 9/1953 | Italy | 4/586 |
| 0264247 | 1/1950 | Switzerland | 5/111 |

*Primary Examiner*—Charles E. Phillips
*Attorney, Agent, or Firm*—Harness, Dickey & Pierce

[57] ABSTRACT

The present invention apparatus for supporting an infant while bathing comprises a fabric mesh which is suspended between a pair of C-shaped cross members located at opposite ends thereof and supported by a "free-standing" support structure. The free standing support structure is defined by the pair of cross members each having a horizontal segment and a pair of vertical leg segments, a series of four corner connectors and at least four rail members. The vertical leg segments are each adjustably attached to a corresponding corner connector and the four rail members are disengagably attached to corresponding corner connectors to define a generally rectangular support frame. An adjustment mechanism is provided for permitting the height of the horizontal segment on the C-shaped cross members to be selectively varied relative to the support frame. Furthermore, the C-shaped cross members, corner connectors and rail members are all constructed from substantially hollow tube sections.

1 Claim, 2 Drawing Sheets

APPARATUS FOR SUPPORTING AN INFANT DURING BATHING

BACKGROUND OF THE INVENTION

This invention relates to an apparatus for use in bathing an infant and specifically to a hammock-like device which is adjustable and free standing for insertion into a bathtub or sink.

It is often desirable to support an infant above or partially within bath water contained in a bathtub or sink. Such a device provides a comfortable surface for the infant to lie upon, allows easier access to the infant by a parent and can prevent an infant from inadvertently rolling over face-down into the water.

In general, two types of infant supporting devices are known in the art for supporting infants during bathing. The first is a free standing unit with examples shown and described in U.S. Pat. Nos. 3,837,019 and 2,507,848. The second type of infant bathing device is supported from a portion of the tub or sink. Examples of this type of infant supporting device are shown in U.S. Pat. Nos. 4,837,871, 2,560,575, and 2,491,223. While such inventions have improved the art, many disadvantages still remain.

SUMMARY OF THE INVENTION

In accordance with the present invention, the preferred embodiment of an apparatus for supporting an infant during bathing comprises a fabric mesh which is suspended between a pair of C-shaped cross members located at opposite ends thereof and supported by a "free-standing" adjustable structure. The free standing adjustable structure is defined by the pair of cross members, four corner connectors and at least four rail members. The cross members each have a horizontal segment and a pair of vertical leg segments. Each vertical leg segment is adjustably attached to a corresponding corner connector and the four rail members are each disengagably attached to a pair of corresponding corner connectors. Furthermore, the cross members, corner connectors and rail members are all constructed from substantially hollow tube sections. Accordingly, the apparatus is variably adjustable in height and can be easily disassembled for transportation and storage.

Additional advantages and features of the present invention will become apparent from the following description and appended claims, taken in conjunction with the accompanying drawings.

DETAILED DESCRIPTION OF THE PREFERRED EMBODIMENT

Figure 1:
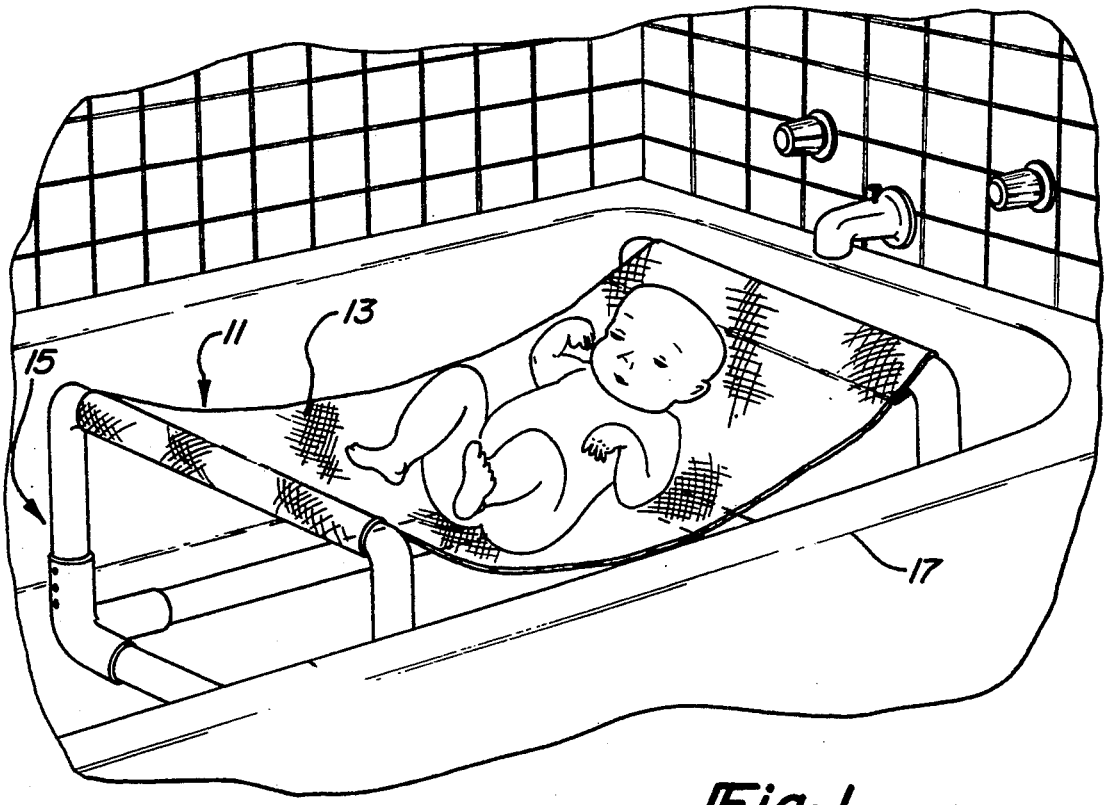
FIG. 1 is a perspective view showing the preferred embodiment of the present invention apparatus for supporting an infant during bathing, in relation to a bathtub.
Figure 2:
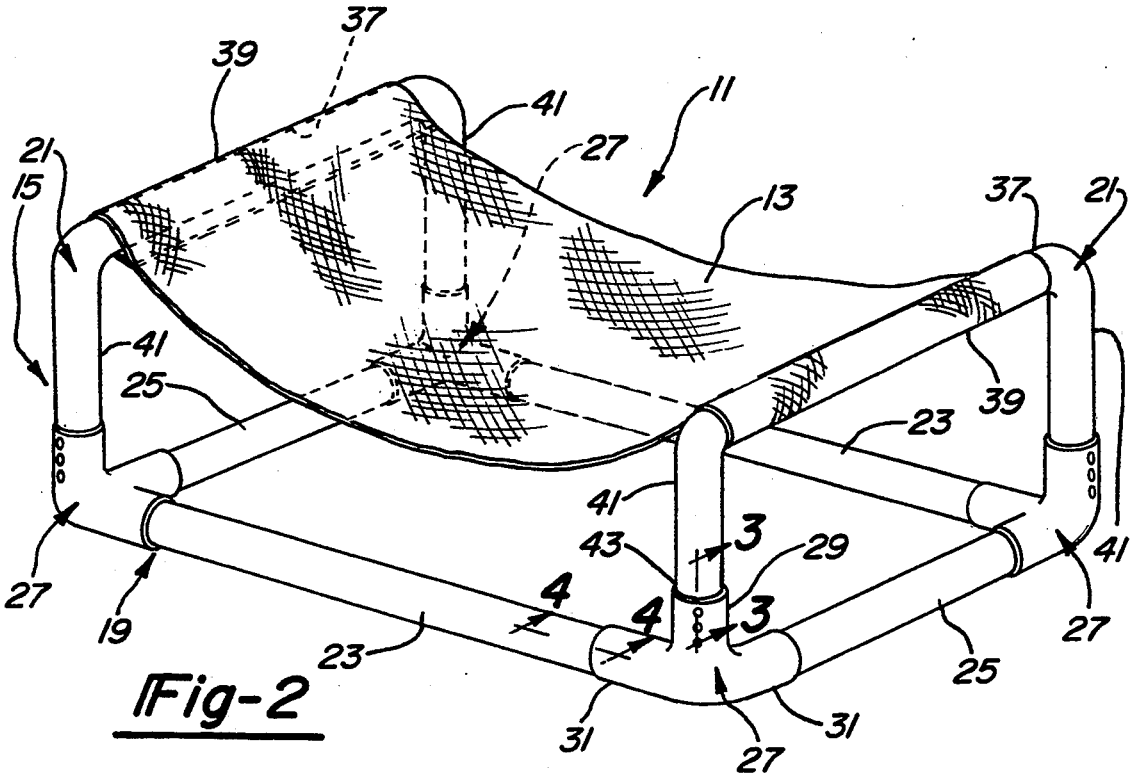
FIG. 2 is a perspective view of the present invention apparatus of FIG. 1.

In accordance with the present invention, an apparatus 11 is used to support an infant during bathing. Referring to FIGS. 1 and 2, apparatus 11 is a hammock-like device which has a water permeable fabric mesh 13 supported by an adjustable and detachable "free-standing" support structure 15. As shown, the infant is laid upon the top of fabric mesh 13 which is adjustably located above or partially within the bath water. Free standing support structure 15 is suitable for placement within a bathtub 17 or sink (not shown). More particularly, support structure 15 includes a generally rectangular support frame 19 and a pair of generally C-shaped cross members 21 between which fabric mesh 13 is suspended. Support frame 19 is defined by interconnecting a pair of side rails 23 and end rails 25 between a set of four corner connectors 27. In a preferred construction, cross members 21, side rails 23, end rails 25 and corner connectors 27 are all made from substantially hollow polymeric tube sections. As will be detailed, the various modular components of apparatus 11 can be quickly disassembled or "knocked down" for easy storage following use.

Figure 4:
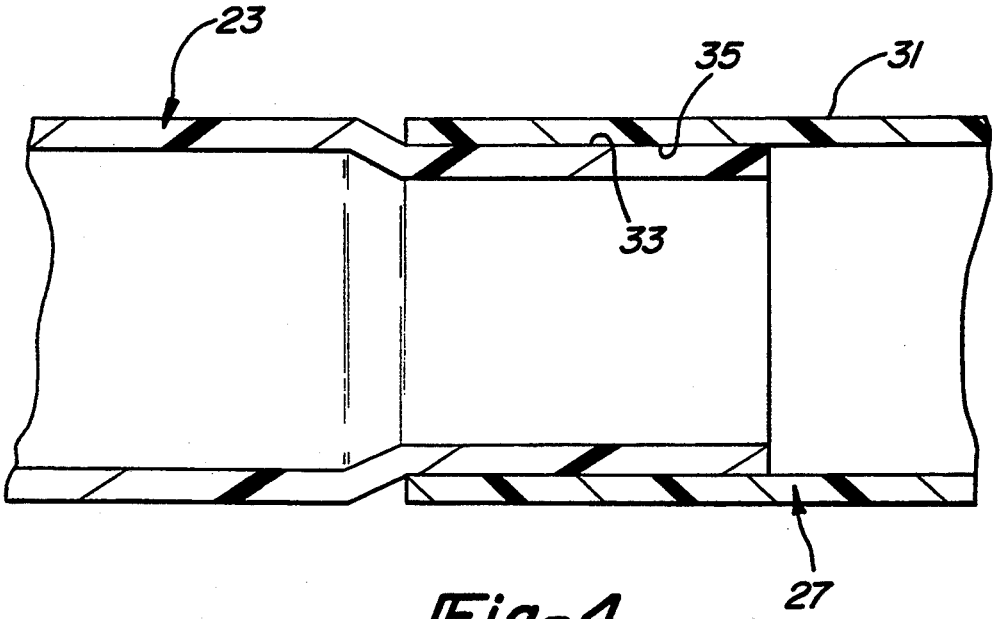
FIG. 4 is a sectional view of the present invention apparatus, taken along line 4—4 of FIG. 2.

As best seen from FIG. 2, each corner connector 27 includes a vertically extending segment 29 and a pair of horizontally extending segments 31 with each of the segments being oriented orthogonally with respect to the other segments. In the assembled construction shown, the opposite ends of each side rail 23 and end rail 25 are inserted into horizontally extending segments 31 of corner connectors 27 to establish a planar rectangular support frame 19 adapted for placement within bathtub 17. Preferably, each end of side rail 23 is disengagably attached to horizontal segment 31 of corner connector 27 by an interference press fit. This arrangement is clearly shown in FIG. 4 wherein an end portion of side rail has a smaller cylindrical outer surface 33 than a mating inside surface 35 of horizontal segment 31. Therefore, each side rail 23 can be easily attached and disengaged from corner connectors 27 for easy transportation and storage of apparatus 11.

Figure 3:
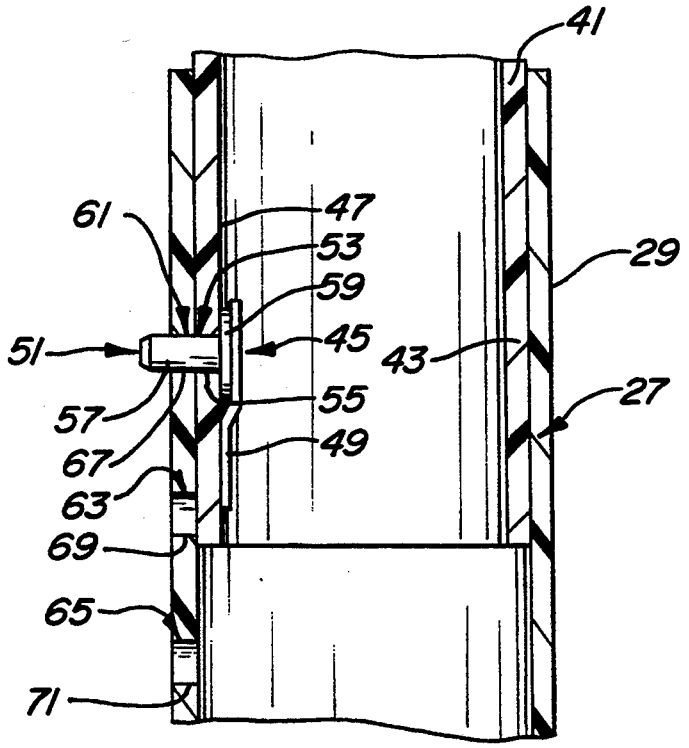
FIG. 3 is a sectional view of the present invention apparatus, taken along line 3—3 of FIG. 2.

Referring specifically to FIGS. 1 through 3, each cross member 21 is shown to have a horizontal segment 37 on which a looped end 39 of fabric mesh 13 is supported and a pair of vertical leg segments 41 extending transversely therefrom. The distal end 43 of each leg segment 41 is adapted for insertion into vertical segments 29 of corner connectors 27 so as to align horizontal segment 37 in a common vertical plane with its end rail 25. In addition, support structure 15 is shown to include means for adjusting the height of fabric mesh 13 relative to support frame 19 by adjusting the inserted position of distal end 43 of leg segments 41 within vertical segments 29 of corner connectors 27. More specifically, an adjustment mechanism 45 is mounted to an inside surface 47 of vertical leg segment 41. Adjustment mechanism 45 is comprised of a leaf spring 49 made from spring steel which is riveted or heat staked to inside surface 47. Leaf spring 49 forcibly pushes a plastic pin 51 or push button through an opening 53 defined by an edge 55 in vertical leg segment 41. Pin 51 has a cylindrically shaped shaft 57 and a larger diameter head 59 inwardly mounted thereupon. Opening 53 can be adjustably registered with a set of vertically aligned orifices 61, 63, 65 and defined by edges 67, 69 and 71, respectively, all of which are juxtapositioned within vertical segment 29 of corner connector 27. Pin 51 adjustably locks distal end 43 of vertical leg segment 41 into vertical segment 29 of corner connector 27 by protruding through both opening 53 within vertical leg segment 41 and preselected orifice 61 of first vertical segment 29. A person can adjust the height of apparatus 11 by pressing in pin 51 until another orifice 63 or 65 is aligned with opening 53.

While the preferred embodiment of this apparatus has been disclosed, it will be appreciated that various modifications may be made without departing from the present invention. For example, the adjustment mechanism may be reversed so that it is mounted upon each corner connector. Furthermore, each rail may be attached to each corresponding corner connector using a similar adjustment mechanism. Various materials have been disclosed in an exemplary fashion, however, other materials may of course be employed. It is intended by the following claims to cover these and any other departures from the disclosed embodiments which fall within the true spirit of this invention.

What is claimed is:

1. An apparatus for supporting an infant during bathing comprising:

four corner connectors each comprising a vertically extending tubular section and two horizontal tubular sections extending generally orthogonal to said vertical section, said vertical section having a plurality of vertical orifice extending along a wall thereof;

first and second tubular side rails and a pair of tubular end rails, each of which extend horizontally between a respective adjacent pair of said four corner connectors, each of said first and second side and end rails have ends thereof which are disengagably interference press fit inserted into respective horizontal segments of each of said four corner connectors thereby forming a rectangular base;

first and second one-piece C-shaped cross members each having a substantially horizontal tubular segment and unitary first and second tubular vertical leg segments extending transversely therebelow, said first and second vertical leg segments each having a distal end for insertion into a vertical tubular section;

a spring biased compressible pin on the distal end of each first and second vertical leg segments for insertion into a preselected one of said orifices;

a fabric mesh being suspended horizontally between said horizontal segments of said first and second cross members and being attached thereto, said fabric mesh otherwise freely hanging therebetween for cradling an infant in said fabric mesh;

said distal end of each of said pair of vertical leg segments is adjustably inserted into said vertical segment of said corresponding corner connector for enabling vertical height adjustment of said vertical leg segments and the attached fabric mesh via engagement of said pin with a selected one of said orifices;

a side rail and two respective vertical leg segments of each said first and second C-shaped cross members forming a substantially U-shaped portion having an open upper side on either side of said apparatus thereby permitting substantially direct horizontal access to an infant placed on said mesh with its head and feet at respective C-shaped cross members.

* * * * *